US006547924B2

(12) United States Patent
Klerelid et al.

(10) Patent No.: US 6,547,924 B2
(45) Date of Patent: Apr. 15, 2003

(54) PAPER MACHINE FOR AND METHOD OF MANUFACTURING TEXTURED SOFT PAPER

(75) Inventors: Ingvar B.E. Klerelid, Karlstad (SE); Anders T. Lindén, Karlstad (SE); Robert S. Ampulski, Fairfield, OH (US); Ward W. Ostendorf, West Chester, OH (US); Osman Polat, Montgomery, OH (US)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/916,756

(22) Filed: Jul. 27, 2001

(65) Prior Publication Data

US 2002/0062936 A1 May 30, 2002

Related U.S. Application Data

(63) Continuation of application No. 09/212,798, filed on Dec. 16, 1998, now abandoned.

(30) Foreign Application Priority Data

Mar. 20, 1998 (SE) ..... 9800949-1

(51) Int. Cl.[7] ..... D21H 11/00

(52) U.S. Cl. ..... 162/109; 162/361; 162/362; 162/205; 162/358.2; 162/358.4; 162/901; 442/218

(58) Field of Search ..... 428/167, 172; 442/218; 162/109, 111, 113, 116, 117, 900, 901, 903, 358.2, 358.4, 362, 358.3, 205, 305, 361

(56) References Cited

U.S. PATENT DOCUMENTS

| | | | |
|---|---|---|---|
| 3,301,746 | A | 1/1967 | Sanford et al. |
| 3,537,954 | A | 11/1970 | Justus |
| 3,840,429 | A | 10/1974 | Busker et al. |
| 3,994,771 | A | 11/1976 | Morgan, Jr. et al. |
| 4,239,065 | A | 12/1980 | Trokhan |
| 4,271,222 | A | 6/1981 | Hahn |

(List continued on next page.)

FOREIGN PATENT DOCUMENTS

| | | |
|---|---|---|
| CA | 1 188 556 | 6/1985 |
| DE | 42 24 731 A1 | 2/1994 |
| DE | 195 43 111 A1 | 5/1997 |
| DE | 195 48 747 A1 | 7/1997 |
| WO | WO 82/03595 | 10/1982 |
| WO | WO 84/02873 | 8/1984 |
| WO | WO 91/16493 | 10/1991 |
| WO | WO 94/28240 | 12/1994 |
| WO | WO 95/00706 | 1/1995 |
| WO | WO 95/16821 | 6/1995 |
| WO | WO 96/00812 | 1/1996 |
| WO | WO 98/51859 | 11/1998 |

*Primary Examiner*—Steven P. Griffin
*Assistant Examiner*—Dionne A. Walls
(74) *Attorney, Agent, or Firm*—Alston & Bird LLP

(57) ABSTRACT

A paper machine for manufacturing textured soft paper comprises a press section with a press nip, through which an impermeable belt and a felt run with the fibrous web between them, a drying cylinder and a transfer roll forming a nip for transfer of the web to the drying cylinder. According to the invention the belt is a texturing belt having a back layer and a web-contacting layer having depressions with surface portions situated between them to form a relief pattern in the web upon passage through the press nip, the texturing belt running from the press to the drying cylinder in order to carry the textured web to the transfer nip. The felt runs away from the texturing belt before a water film formed in the press nip on the texturing belt breaks up. A device is provided before the transfer nip to apply adhesive on the drying cylinder.

36 Claims, 6 Drawing Sheets

U.S. PATENT DOCUMENTS 4,309,246 A 1/1982 Hulit et al.
4,312,907 A 1/1982 Hiraoka et al.
4,369,081 A 1/1983 Curry et al.
4,440,597 A 4/1984 Wells et al.
4,440,598 A 4/1984 Koski et al.
4,483,745 A 11/1984 Wicks et al.
4,500,588 A 2/1985 Lundström
4,514,345 A 4/1985 Johnson et al.
4,518,640 A 5/1985 Wilkens
4,528,239 A 7/1985 Trokhan
4,529,480 A 7/1985 Trokhan
4,529,643 A 7/1985 Lundström
4,533,437 A 8/1985 Curran et al.
4,552,620 A 11/1985 Adams
4,752,519 A 6/1988 Boyer et al.
4,834,838 A 5/1989 Klowak
4,849,054 A 7/1989 Klowak
4,861,430 A 8/1989 Andersson
4,919,756 A 4/1990 Sawdai
4,976,821 A 12/1990 Laapotti
5,002,638 A 3/1991 Gulya et al.
5,098,522 A 3/1992 Smurkoski et al.
5,175,037 A 12/1992 Merckens et al.
5,232,768 A 8/1993 Eklund et al.
5,238,537 A 8/1993 Dutt
5,260,171 A 11/1993 Smurkoski et al.
5,275,700 A 1/1994 Trokhan
5,298,124 A 3/1994 Eklund et al.
5,328,565 A 7/1994 Rasch et al.
5,334,289 A 8/1994 Trokhan et al.
5,346,567 A 9/1994 Barnewall
5,364,504 A 11/1994 Smurkoski et al.
5,372,876 A 12/1994 Johnson et al.
5,393,384 A 2/1995 Steiner et al.
5,411,636 A 5/1995 Hermans et al.
5,431,786 A 7/1995 Rasch et al.
5,468,349 A 11/1995 Schiel
5,496,624 A 3/1996 Stelljes, Jr. et al.
5,500,277 A 3/1996 Trokhan et al.
5,514,523 A 5/1996 Trokhan et al.
5,529,664 A 6/1996 Trokhan et al.
5,554,467 A 9/1996 Trokhan et al.
5,556,509 A 9/1996 Trokhan et al.
5,566,724 A 10/1996 Trokhan et al.
5,569,358 A 10/1996 Cameron
5,580,423 A 12/1996 Ampulski et al.
5,591,305 A 1/1997 Cameron
5,609,725 A 3/1997 Van Phan
5,624,790 A 4/1997 Trokhan et al.
5,628,876 A 5/1997 Ayers et al.
5,629,052 A 5/1997 Trokhan et al.
5,637,194 A 6/1997 Ampulski et al.
5,650,049 A 7/1997 Kivimaa et al.
5,662,777 A 9/1997 Schiel et al.
5,667,636 A 9/1997 Engel et al.
5,674,663 A 10/1997 McFarland et al.
5,855,739 A 1/1999 Ampulski et al.
5,972,813 A * 10/1999 Polat et al. ..... 442/320
6,340,413 B1 1/2002 Nilsson et al.

* cited by examiner

PAPER MACHINE FOR AND METHOD OF MANUFACTURING TEXTURED SOFT PAPER

CROSS-REFERENCE TO RELATED APPLICATIONS

This application is a continuation of U.S. application Ser. No. 09/212,798, filed on Dec. 16, 1998, now abandoned, which is hereby incorporated in its entirety by reference. This application also claims the benefit of U.S. patent application Ser. No. 08/992,285 (U.S. Pat. No. 5,972,813), filed Dec. 17, 1997, which is incorporated herein by reference.

FIELD OF THE INVENTION

The present invention relates to papermaking machines and methods of making paper, and more particularly relates to machines and methods for making textured soft paper, such as tissue.

BACKGROUND OF THE INVENTION

A paper machine for the production of tissue paper is disclosed in U.S. Pat. No. 5,393,384, see particularly FIG. 6. The paper machine shown therein has a belt impermeable to water, which runs in a loop through an extended press nip formed by a shoe press roll and a counter roll. A press felt is conveyed directly to the press nip, where it is brought together with the impermeable belt and the paper web. The paper web is transferred from a forming fabric to the impermeable belt which is to carry the paper web on its under side up to the press nip and thence to the drying cylinder. The impermeable belt thus carries the paper web a relatively long distance after the paper web has been transferred from the forming fabric to the impermeable belt. There is therefore a risk of the paper web not adhering sufficiently strongly along the entire distance and thus becoming detached from the impermeable belt. According to the patent specification the adhesion force between the impermeable belt and the paper web is greater than that between the press felt and the paper web. The impermeable belt under discussion here is not compressible and has a smooth, web-carrying surface.

It is generally known that such a smooth, impermeable belt obtains a film of liquid on its smooth, web-carrying surface when belt, press felt and paper web pass together through a press nip and that, after the press nip, the paper web therefore adheres to the impermeable belt instead of to the press felt which does not have a smooth surface, when the press felt and the impermeable belt run away from each other. This situation is also utilized in U.S. Pat. No. 4,483,745. Since, however, both the impermeable belt and the drying cylinder in the paper machine according to U.S. Pat. No. 5,393,384 have smooth surfaces with which the paper web is intended to come into contact, there is considerable risk of the paper web continuing to adhere to the smooth surface of the impermeable belt after it has passed the nip at the drying cylinder instead of being transferred to the smooth surface of the drying cylinder as desired. Probably not even the application of large quantities of adhesive on the envelope surface of the drying cylinder would ensure adhesion of the paper web to the drying cylinder. U.S. Pat. No. 5,393,384 mentions nothing about texturing the paper web before the drying cylinder.

DE-195 48 747 discloses a paper machine for manufacturing creped tissue paper which is provided with a press comprising a shoe press roll, a counter roll and a suction roll, the counter roll forming a first press nip with the suction roll and a second extended press nip with the shoe press roll. A felt passes through the two press nips together with the paper web and then carries the paper web with it to a Yankee dryer, to which the paper web is transferred when the felt and the paper web pass around a transfer roll forming a non-compressing nip with the Yankee dryer. Suction zones are provided before and after the first press nip, the suction zone before the press nip being situated within the suction roll whereas the suction zone after the press nip is in a side loop in which the felt runs alone and joins the paper web again at the entry to the second press nip. One drawback with such a paper machine is that the paper web is exposed to re-wetting by the wet felt before it reaches the Yankee dryer. The paper machine has no impermeable belt, nor does the patent specification mention anything about texturing the paper web.

U.S. Pat. No. 5,298,124 discloses a compressible transfer belt for use in a paper or board making machine in order to eliminate open draws in the paper web and to easily release the paper web so that it can be transferred to a fabric or belt. The transfer belt carries the paper web through the press section, which comprises one or more press nips, and on to the drying section which comprises a plurality of drying cylinders and a belt passing in a loop around a transfer roll which forms a nip with the transfer-belt. Each press is also provided with a felt passing through its press nip and enclosing the paper web between it and the transfer belt. The impermeable transfer belt is also so designed that a liquid film formed in a press nip between the transfer belt and the paper web breaks up when the pressure on the transfer belt ceases after the press nip so that its release properties increase and the paper web can thus more easily be transferred to a fabric or another belt running in a loop. There is no suggestion or intimation in the patent specification that the transfer belt should be allowed to carry the paper web to a drying cylinder in a tissue machine. Nor is there any mention of texturing the paper web.

U.S. Pat. No. 5,298,124 offers an excellent description of the tasks a transfer belt cooperating with a press felt shall perform in a satisfactory manner, and also of the properties and design of such transfer belts which then were disclosed in patent specifications U.S. Pat. Nos. 4,483,745, 4,976,821, 4,500,588, 5,002,638, 4,529,643 and CA-A-1,188,556.

According to U.S. Pat. No. 5,298,124, for a transfer belt intended for cooperation with a press felt the critical tasks are a) to remove the paper web from the press felt without causing instability problems; b) to cooperate with the press felt in one or more press nips to ensure optimal dewatering and high quality of the paper web, and c) to transfer the paper web in a closed draw from a press in the press section to a paper web receiving fabric or belt in the following press or presses of the press section or to a pick-up fabric in the drying section.

As mentioned, the transfer belt for the press section of a paper machine disclosed in U.S. Pat. No. 5,298,124 has a web-contacting surface which is substantially impermeable to water and air and has a pressure-responsive microscale topography. Under influence of the pressure in a press nip in the press section, the transfer belt is compressed so that the microscale roughness of said surface is decreased, whereupon the surface becomes much smoother and allows the formation of a thin, continuous film of water thereon.

Paper machines for manufacturing soft paper with high bulk are known through a plurality of patent specifications.

An imprinting fabric or felt is generally used which passes, together with the paper web formed, through a press nip in which the paper web is pressed into the imprinting fabric, thus acquiring a texture pattern on one side. Paper machines having such texturing fabrics and press nips are disclosed in U.S. Pat. Nos. 3,301,746, 3,537,954, 4,309,246, 4,533,437, 5,569,358, 5,591,305 and WO 91/16493. The drawback with the paper machines disclosed in these publications is that dewatering in the press nip is relatively low and the dry solids content of the paper web is therefore low when the paper is transferred to the drying cylinder. The production rate of the paper machine is thus relatively low.

U.S. Pat. No. 4,849,054 discloses a machine for manufacturing an imprinted fabric web with high bulk without the use of a press nip. A roll, e.g., a transfer roll or felt-carrying roll, forms a nip with an imprinting fabric at a transfer point for the web where the imprinting fabric passes around a suction tube with a slit opening facing the transfer point. The nip is so wide that the web is not compressed when it passes through. The suction effect from the suction tube via the narrow slit opening is sufficient to ensure that the web is not only transferred to the imprinting belt but is also shaped in compliance with the surface of the imprinting belt facing the web, this belt having a three-dimensional pattern. Prior to the transfer point the speed of the fabric web is greater than that of the imprinting fabric. The roll carrying the web to the non-compressing nip has a smooth surface and it is generally known that in practice considerable problems are entailed in transferring a fabric web from a smooth surface to a fabric, which fabric web has been pre-pressed to a dry solids content of 30–50%.

U.S. Pat. No. 5,411,636 discloses manufacture of soft paper where the paper web is formed on a forming fabric, pre-pressed in a double-felted press nip and transferred to a coarse-meshed fabric. When the paper web is carried by the coarse-meshed fabric it is subjected to a vacuum in a suction zone so that the paper web is sucked into the openings and depressions in the fabric and thereby acquires increased thickness and thus increased bulk. The coarse-meshed fabric then carries the paper web to the drying cylinder. The double-felted press nip ensures that the dry solids content of the paper web is relatively low, i.e., 25–30%. Since no dewatering can be performed in the nip at the drying cylinder, the dry solids content of the paper web upon transfer to the drying cylinder is correspondingly low. Furthermore, it is extremely difficult to transfer the paper web from the felt to the coarse-meshed fabric.

Accordingly, an improved paper machine and method of manufacturing textured soft paper would enable the manufacture of a textured fibrous web with high bulk and high dry solids content before the drying cylinder to enable a high production rate to be achieved at a reasonable cost. Further, it would be desirable to reliably transfer the textured fibrous web to the drying cylinder although the fibrous web is carried to the drying cylinder by an impermeable texturing belt.

SUMMARY OF THE INVENTION

The paper machine according to the invention is characterized in that a) the substantially impermeable belt is a texturing belt including a back layer and a web-contacting layer having a multitude of uniformly distributed depressions with surface portions located between them to form an equivalent relief pattern in the fibrous web during its passage through the press nip;

b) the substantially impermeable texturing belt is arranged to run from the press to the drying cylinder in order to carry the textured fibrous web to said transfer nip;

c) the press felt is arranged to run in a direction away from the impermeable texturing belt at a point immediately after said press nip and before a water film formed in the press nip on the substantially impermeable texturing belt breaks up; and d) a device for applying adhesive is arranged before said transfer nip to apply a continuous adhesive layer on the envelope surface of the drying cylinder and/or on the textured fibrous web.

The method according to the invention is characterized by a) texturing the fibrous web by means of the substantially impermeable belt, which is a texturing belt including a carrier and a web-contacting layer having a multitude of uniformly distributed depressions with surface portions located between them to form an equivalent pattern in the fibrous web during its passage through said press nip;

b) running the substantially impermeable texturing belt from the press to the drying cylinder in order to carry the textured fibrous web to said transfer nip;

c) running the press felt in a direction away from the impermeable texturing belt at a point immediately after said press nip and before a water film formed in the press nip on the substantially impermeable texturing belt breaks up; and d) applying a continuous layer of adhesive on the envelope surface of the drying cylinder and/or on the textured fibrous web with the aid of a device for applying adhesive at a point before said transfer nip.

According to the invention it has surprisingly been found that impermeability or substantial impermeability is an extremely favorable property in a texturing belt, that is included in the paper machine according to the invention if the impermeable texturing belt is also used to transport a pressed paper web to the transfer nip at a Yankee dryer in the drying section of the paper machine. The property allows steam which, as a result of heating the Yankee dryer is formed in the depressions or pits in the texturing pattern by the water present in the pits or depressions, to be pressurized, thus pressing the paper fibers also present in the pits or depressions as a result of the press effect in the press section, so that these in the Yankee dryer nip are pressed into the pits or depressions at the same time as the parts of the paper fiber web present between the raised parts of the texturing pattern and the Yankee dryer become thinner. The desired texturing effect and high bulk of the paper web is thus achieved.

The texturing effect and the productivity can be increased if the texturing belt or a layer of the texturing belt intended for contact with the paper web is also given the feature of reversible compressibility so that the texturing belt is compressed in the transfer nip at the Yankee dryer. When the texturing belt then leaves the transfer nip and resumes its uncompressed state, a vacuum is created, which contributes to the formation of steam, which in turn facilitates separation of the texturing belt and paper web after the transfer nip and also quicker drying of the paper web on the Yankee dryer, i.e., higher paper production capacity. The vacuum-forming effect increases the quicker the belt resumes its uncompressed state, i.e., the more resilient the reversible compressibility is.

The texturing effect of the texturing belt that is included in the paper machine according to the invention is, of course, selected taking into consideration the desired texture pattern in the paper to be manufactured. The texture pattern is regular across the texturing belt or, if the texture pattern in the paper web is to include a particularly prominent additional pattern, e.g., a picture, logotype, etc., it has a regular basic pattern of depressions or pits and raised portions, onto which pattern the additional pattern is superimposed. "Regular" does not necessarily imply that the pattern appears regularly in all directions of the texturing belt. For instance, if the paper is soft paper that is to be creped, a tighter dominant transverse pattern (across the machine direction) as compared with a longitudinal pattern of elevations and pits, will give an increased creping effect. Thus, the pattern can be used for altering the properties of the paper in a desired direction.

Taking into consideration the material in the texturing belt or its surface layer that is intended to come into contact with the paper web, the texturing pattern can be achieved in some manner, known per se, such as etching, calendering, laser processing or embossing.

The density of the texturing pattern can also be used to influence the effect of the drying of the paper web on the Yankee dryer. Fewer contact points between the Yankee dryer and the paper web thus results in reduced drying effect from the Yankee dryer but increased drying effect from the hot air hood around the Yankee dryer on the fluffier parts of the paper web located between the thinner contact points.

BRIEF DESCRIPTION OF THE DRAWINGS

The invention will be described in more detail in the following with reference to the attached drawings.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
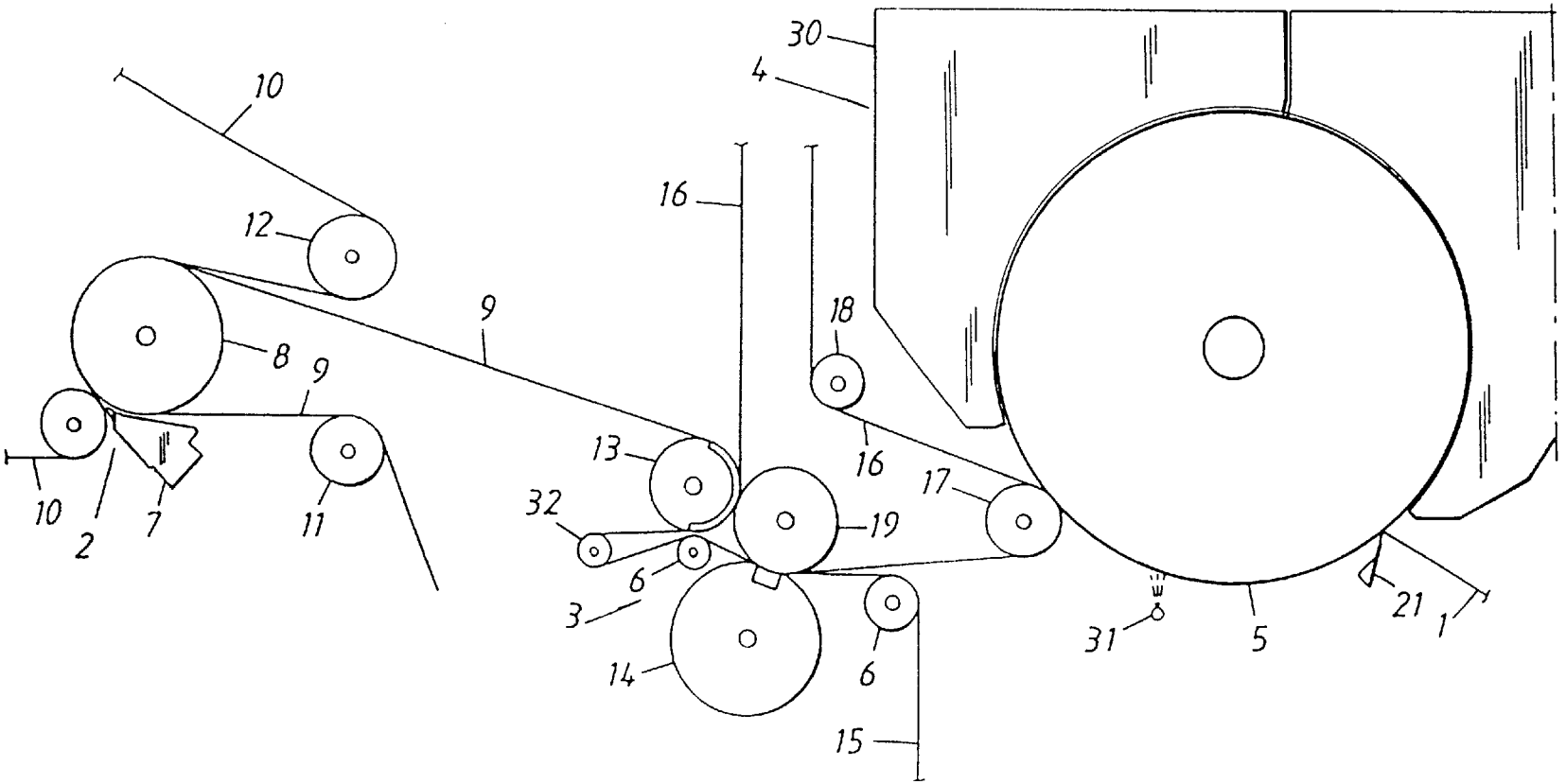
FIG. 1 shows a paper machine according to a first embodiment of the invention.
Figure 2:
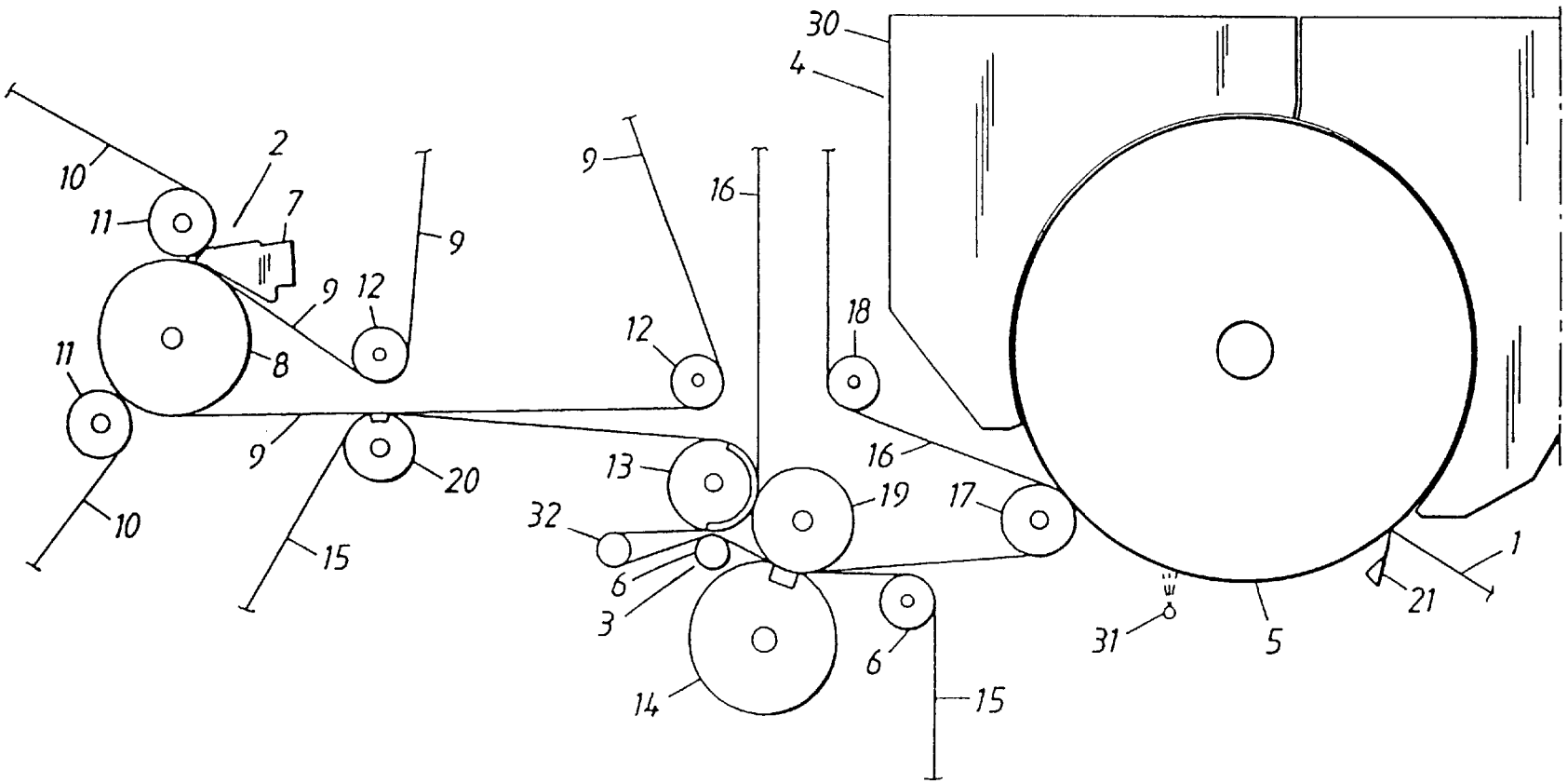
FIG. 2 shows a paper machine according to a second embodiment of the invention.
Figure 3:
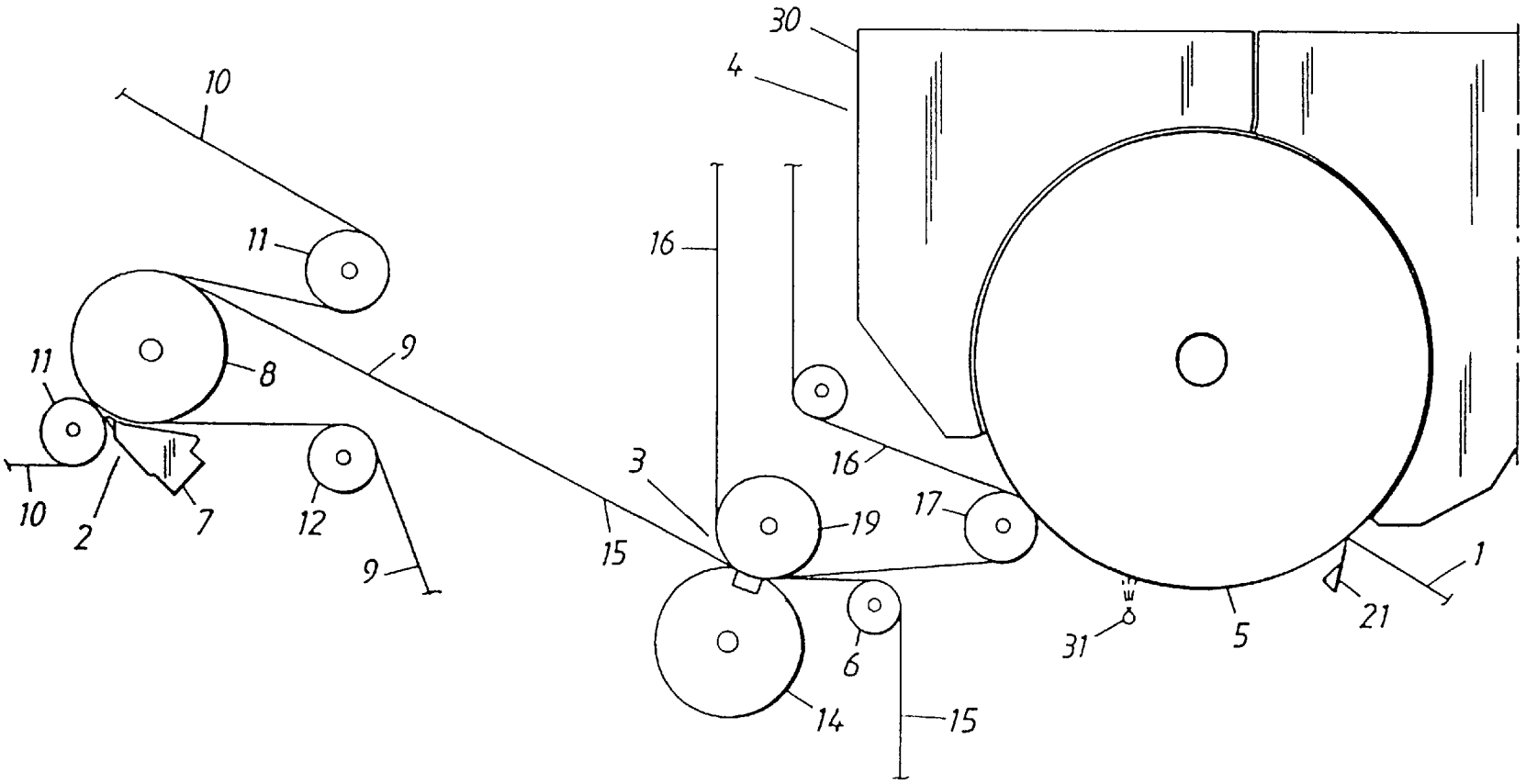
FIG. 3 shows a paper machine according to a third embodiment of the invention.

FIGS. 1–3 show schematically parts of paper machines for manufacturing a textured web 1 of soft paper, such as tissue and other paper products with low density. Each of the paper machines comprises a wet section 2, a press section 3 and a drying section 4.

The wet section 2 includes a headbox 7 a forming roll 8, an endless, carrying, inner clothing 9 and an endless, covering outer clothing 10 consisting of a forming fabric. The inner and outer clothings 9, 10 run, each in its own loop, around a plurality of guide rolls 11 and 12, respectively.

The drying section 4 includes a drying cylinder 5 covered by a hood 30. The drying cylinder is suitably a Yankee dryer. At the outlet side of the drying section a creping doctor is arranged to crepe the fibrous web 1 off the Yankee dryer. An application device 31 is also provided for applying a suitable adhesive on the envelope surface of the Yankee dryer 5 immediately before the transfer nip.

The press section 3 includes a shoe press with a shoe press roll 14 and a counter roll 19, these rolls 14 and 19 forming an extended press nip with each other. The press section also has an endless press felt 15 which runs in a loop around guide rolls 6, and an endless, substantially impermeable belt 16, which according to the invention is a texturing belt. The substantially impermeable texturing belt 16 runs in a loop around the counter roll 19, a transfer roll 17 and a plurality of guide rolls 18. The transfer roll 17 forms a transfer nip with the Yankee dryer 5 with low linear load, i.e., about 30 to 60 kN (kiloNewtons), through which transfer nip the substantially impermeable texturing belt 16 thus passes.

In the embodiments shown in FIGS. 1 and 2 the press section 3 also includes a roll press, constituted by a suction press roll 13 and said counter roll 19 to form a press nip, through which the substantially impermeable texturing belt 16 and the press felt 15 pass together with the fibrous web 1. After this initial press nip, the press felt 15 is conducted away from the fibrous web 1 and the substantially impermeable texturing belt 16 in a side loop around the suction press roll 13 and two guide rolls 32. The press felt 15 rejoins the fibrous web and the substantially impermeable texturing belt 16 immediately before the extended press nip. If desired, suction devices may be arranged within this side loop of the press felt 15 in order to increase the capacity of the press felt to absorb water at the entrance to the extended press nip.

In the embodiments shown in FIGS. 1 and 3, the inner clothing 9 of the wet section 2 is a felt guided to the press section 3 to be also utilized as press felt 15, and which thus runs in a loop back to the forming roll 8.

In the embodiment shown in FIG. 2, the inner clothing 9 of the wet section 2 is a forming fabric, the press felt running around a pick-up roll 20 arranged close to the loop of fabric 9, so that press felt 15 and fabric 9 run in contact with each other to transfer the fibrous web from the fabric 9 to the press felt 15. The pick-up roll 20 may be provided with a suction shoe (not shown). Alternatively, the pick-up roll with suction shoe may be replaced by a pick-up suction box.

Figure 4:
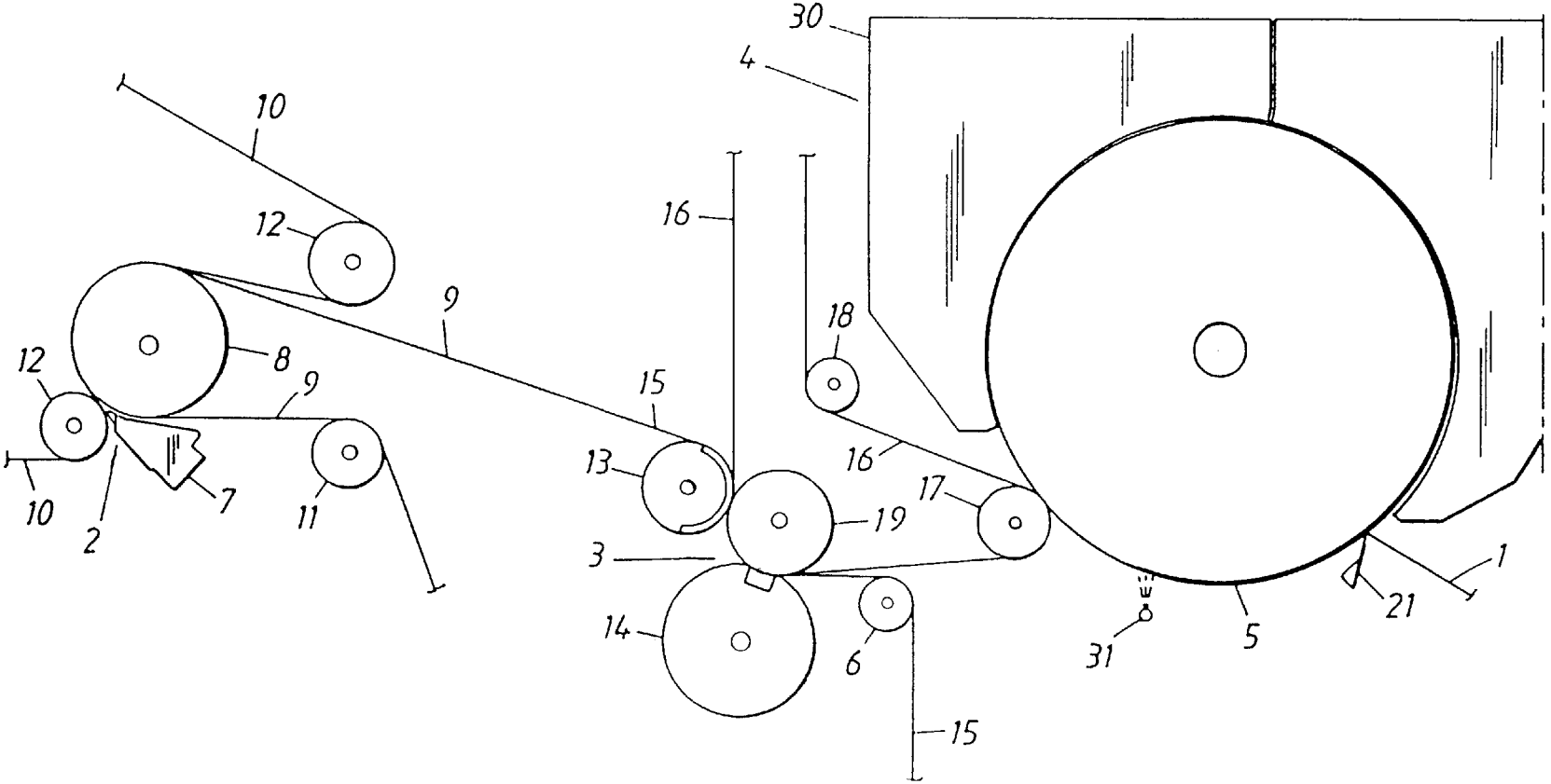
FIG. 4 shows a paper machine according to a fourth embodiment of the invention.

FIG. 4 shows schematically parts of a paper machine according to another embodiment of the invention. It is similar to that shown in FIG. 1 with the exception that the press felt 15 is not led in a side loop between the two press nips, but instead accompanies the counter roll 19, so that the fibrous web 1 is held enclosed between the substantially impermeable texturing belt 16 and the press felt 15. This embodiment can be used when there is little risk of rewetting of the fibrous web.

Figure 5:
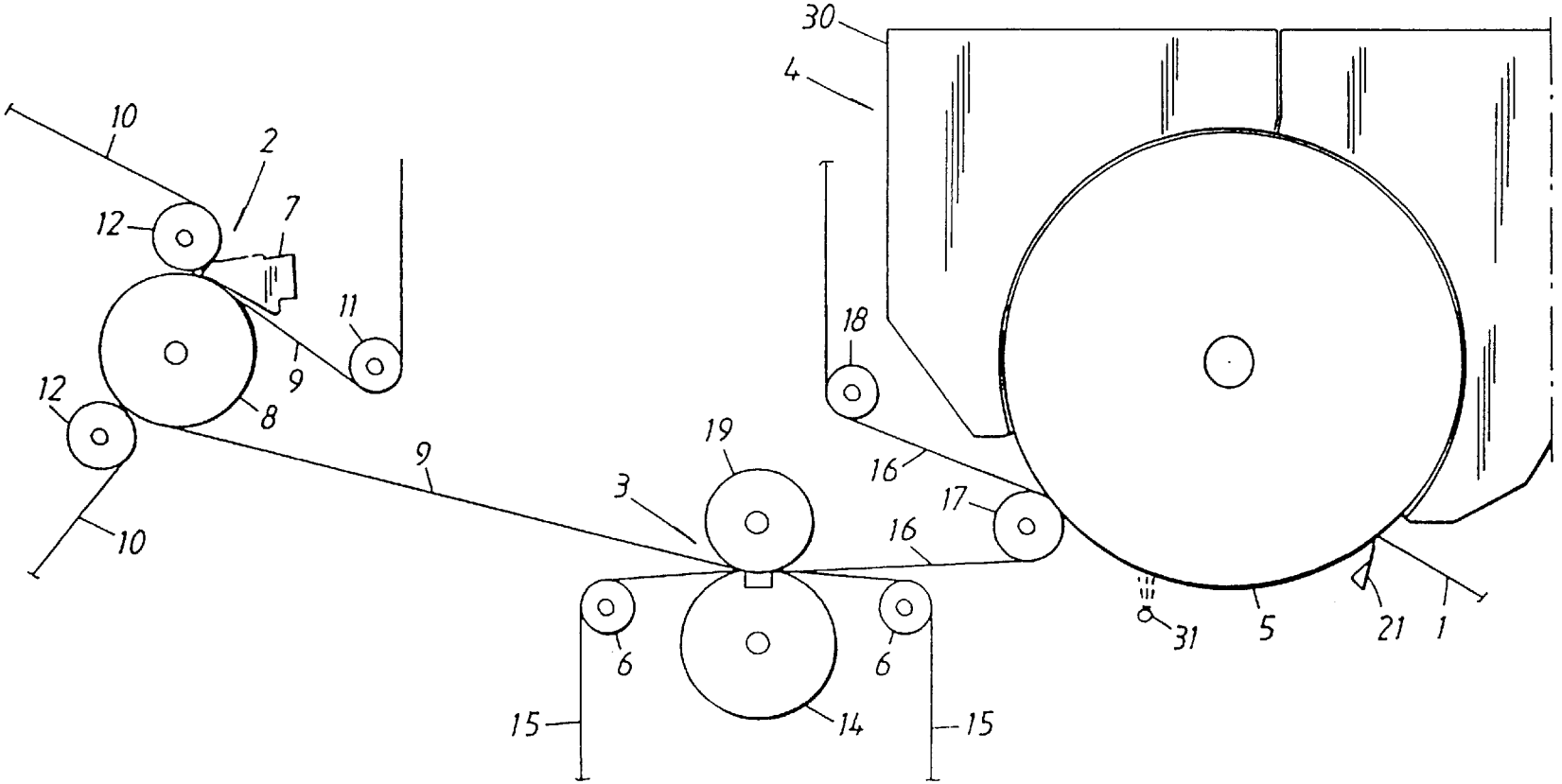
FIG. 5 shows a paper machine according to a fifth embodiment of the invention.
Figure 7:
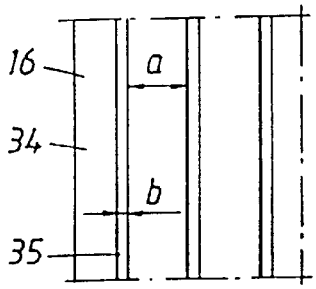
FIG. 7 shows from above a part of a substantially impermeable texturing belt constructed of a back layer in the form of a carrier and a web-contacting layer supported by the carrier, in the form of a resilient, compressible polymer layer, which polymer layer is provided with longitudinal grooves.
Figure 8:
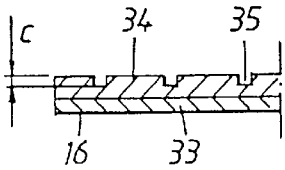
FIG. 8 shows a section through the texturing belt according to FIG. 7.
Figure 9:
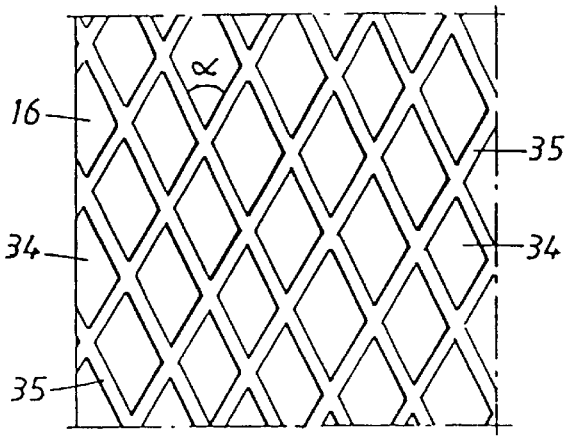
FIG. 9 shows from above a part of a substantially impermeable texturing belt of the same type as that according to FIG. 7, but provided with diagonally intersecting grooves.
Figure 6:
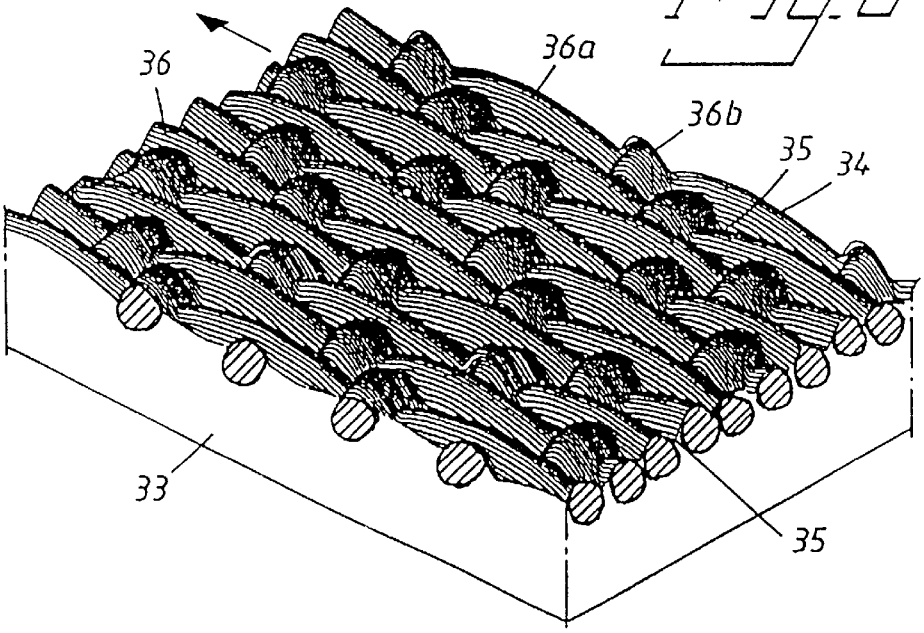
FIG. 6 shows in perspective a part of-a substantially impermeable texturing belt constructed of a back layer in the form of a tight polymer layer and a web-contacting layer in the form of a polymer-coated fabric.

FIG. 5 shows schematically parts of a paper machine according to yet another embodiment of the invention for manufacturing a textured web of soft paper, such as tissue and other sanitary paper products. The paper machine comprises a wet section 2, a press section 3 and a drying section 4. The wet section 2 includes a headbox 7, a forming roll 8, an endless, carrying inner clothing 9 and an endless, covering, outer clothing 10 constituted by a forming fabric. The inner and outer clothings 9 and 10 run in individual loops around a plurality of guide rolls 11 and 12, respectively. The drying section 4 includes a drying cylinder 5 covered by a hood 30. The drying cylinder is suitably a Yankee dryer. At the outlet side of the drying section a creping doctor 21 is provided to crepe the fibrous web off the Yankee dryer 5. An application device 31 is also provided for applying a suitable adhesive on the envelope surface of the Yankee dryer 5 immediately before the transfer nip. The press section 3 includes a shoe press with a shoe press roll 14 and a counter roll 19, these rolls 14 and 19 forming an extended press nip with each other. The press section also has an endless press felt 15 which runs in a loop around guide rolls 6, and an endless, substantially impermeable belt 16, which according to the invention is a texturing belt. The substantially impermeable texturing belt 16 runs in a loop around the counter roll 19, a transfer roll 17 and a plurality of guide rolls 18. The transfer roll 17 forms a transfer nip with the Yankee dryer 5 with low linear load, through which transfer nip the substantially impermeable texturing belt 16 thus passes. In this embodiment the substantially impermeable texturing belt 16 is also used as the inner clothing 9 in the wet section 2, its loop being extended to the forming roll 8. The substantially impermeable texturing belt 16 thus runs in a loop between the wet section 2 and the drying section, around the transfer roll 17, guide rolls 18 and 11 and forming roll 8. The substantially impermeable texturing belt carries the fibrous web on its under side from the forming roll to the drying cylinder.

In the embodiments shown in FIGS. 1 to 5, the counter roll 19 is a smooth roll and is arranged in a loop of the substantially impermeable texturing belt 16. In an alternative embodiment (not shown) of the press section according to FIGS. 3 and 5, the positions of the rolls 14 and 19 are reversed, i.e., the shoe press roll 14 is arranged in the loop of the substantially impermeable texturing belt 16, and the counter roll is in the loop of the press felt 15. In such a configuration the counter roll may be a suction roll, a grooved roll or a blind-drilled roll.

The substantially impermeable texturing belt used in the embodiments above of the paper machine according to the invention comprises a back layer 33 and a web-contacting layer 34 having a multitude of uniformly distributed depressions 35 with flat or arched surface portions 36 situated therebetween, see FIGS. 6 to 9. According to the first embodiment, shown in FIG. 6, the substantially impermeable texturing belt 16 consists of a tight layer 33 forming said back layer and a fabric forming said web-contacting layer 34. The fabric 34 is coated with a polymer enclosing the threads of the fabric without altering the structure of the fabric, which is formed of depressions and arched or convex surface portions 36 situated between the depressions. The depressions 35 and surface portions 36 are in turn formed by the threads of the fabric extending in the machine direction (as indicated by the arrow) and transverse to this. The depressions 35 are sealed by the tight back layer 33 formed by coating polymer on the surface of the fabric not coming in contact with the web. Said arched surface portions 36 comprise both oblong arc-shaped ridges **36*a* of the longitudinally running fabric threads, and also knuckles 36*b* of the transversely running threads, which knuckles produce small bowl-shaped pits in the fibrous web in the texturing phase. In the embodiment shown in FIG. 6, the substantially impermeable texturing belt has 100 knuckles 36*b* per $cm^2$. In general it may have 25 to 150 knuckles/$cm^2$, preferably 50 to 100 knuckles/$cm^2$. This structure of depressions, ridges and knuckles produces a corresponding texture pattern in the fibrous web when it runs through the extended press nip together with the texturing belt 16 and press felt 15. The polymer coating on the fabric ensures that the fibrous web is reliably adhered to the substantially impermeable texturing belt as it runs out from the extended press nip. This ensures that the fibrous web accompanies the substantially impermeable texturing belt 16 and not the press felt 15. The structure of the web-contacting layer of the impermeable texturing belt, i.e., the polymer-coated fabric 34, combined with the envelope surface of the drying cylinder 5 being coated with a continuous adhesive layer, also ensures that the fibrous web is safely transferred to the drying cylinder 5** when it passes through and out of the transfer nip.

What is generally termed a coarse, single-layered fabric, having 100 knuckles/$cm^2$ may be used in the first embodiment of the substantially impermeable texturing belt described above. The back layer, which is substantially impermeable, may consist of a suitable polymer resin material, e.g., the polymers described below for the polymer layer in the second embodiment of the substantially impermeable texturing belt. The polymer for coating the fabric threads may be selected in the same way.

According to a second embodiment, the substantially impermeable texturing belt 16 consists of a carrier 33, which forms said back layer 33, and a polymer layer 34 on its web-contacting side having a hardness of 50 to 97 Shore A, the polymer coating having a degree of roughness in uncompressed state of $R_z$=2 to 80 $\mu$m, measured in accordance with ISO 4287, Part I, and being compressible to a lower degree of roughness of $R_z$=0 to 20 $\mu$m when a linear load of 20 to 200 kN/m is applied in the substantially impermeable texturing belt, and also has the ability to be recovered to its uncompressed degree of roughness when the pressure exerted on the substantially impermeable texturing belt ceases. The $R_z$-value is more specifically the ten-point height, which is defined in said ISO norm as the average distance between the five highest peaks and the five deepest valleys in the reference length measured from a line parallel to the mid-line and not crossing the surface profile. The substantially impermeable texturing belt preferably has an air permeability of less than 6 $m^3/m^2$/minute, measured in accordance with the procedure described in "Standard Test Method for Air Permeability of Textile Fabrics, ASTM D 737-75, American Society of Testing and Materials".

The substantially impermeable texturing belt 16 is thus compressible under the influence of the pressure forces prevailing in the extended press nip. The substantially impermeable texturing belt 16 therefore assumes an uncompressed state upstream and downstream of the extended press nip, the surface, the web-carrying surface facing the fibrous web, having a high degree of roughness in the uncompressed state of the substantially impermeable texturing belt and a lower degree of roughness in the compressed state of the substantially impermeable texturing belt, so that the web-carrying surface in the compressed state of the substantially impermeable texturing belt is sufficiently smooth for a continuous liquid film to be formed on the web-carrying surface, when the substantially impermeable texturing belt, together with press felt 15 and fibrous web 1, passes through the extended press nip, and so that the web-carrying surface in the uncompressed state of the substantially impermeable texturing belt is sufficiently rough to permit the continuous liquid film to be broken up after the substantially impermeable texturing belt has expanded in thickness.

The compressible polymer layer 34 is provided with said multitude of uniformly distributed depressions 35, in order to take up a large share of the web-contacting surface, viz. from 20% up to 50%. The depressions can be formed in many ways to achieve the desired effect of texturing a relief pattern in the fibrous web in order to increase its bulk. The depressions may consist of continuous grooves in the polymer layer 33, see FIG. 7, which extend in machine direction. According to another embodiment, the grooves extend diagonally from one edge to the other, forming an angle of 10° to 80° to the machine direction. According to another embodiment, see FIG. 8, the depressions consist of diagonally intersecting grooves which extend in one group from the first edge to the second edge, and in a second group from the second edge to the first edge, intersecting grooves forming an angle $\alpha$ of 10° to 170°. The grooves in the various embodiments may be straight, as shown, or wave shaped or the like, e.g., sinus shaped or zigzag shaped. The distance a between two grooves 35 running in the same direction may be within the interval 1 to 3 mm. The width b of the groove is within the interval 0.5 to 1.0 mm and its depth c within the interval 0.1 to 1.0 mm.

According to another embodiment (not shown) the depressions comprise hollows of the same or similar shapes. These hollows may be circular, elliptical or polygon in shape, e.g., triangular, rectangular or hexagonal, the largest dimension lying within the interval 0.5 to 3.0 mm and the depth within the interval 0.5 to 1.0 mm.

All or some of the depressions, individually or in groups, may be constituted by hollows of special symbol shapes, e.g., numbers, letters, trade or company symbols repeated at regular intervals within a length unit of the belt.

The substantially impermeable texturing belt according to said second embodiment may be built up in accordance with the recipes described in U.S. Pat. No. 5,298,124, discussed in the introduction. The polymer coating 34 comprises a polymer composition such as acrylic polymer resin, polyurethane polymer resin and polyurethane/polycarbonate resin composition The polymer coating also contains particles of a filler, which have a different hardness from the polymer material and may consist of kaolin, clay, polymer material or metal, preferably stainless steel. The carrier constituting the back layer 33 includes all types of base elements that can in some way be made endless. The term also covers base elements provided with seams. The carrier may consist, for instance, of a single-layered or multilayered fabric produced from monofilaments such as polyester, polyamide, and the like. The base element may even consist of a fiber web (non-woven) held together by adhesive, combined wound yarns, polymer foil/film, warp knitting, or the like.

The carrier may be coated on the rear side with a polymer material of the same type as that used for the polymer layer 34.

It is surprising that a transfer belt as described in U.S. Pat. No. 5,298,124, which is intended for pressing in a press section and usable for transferring a paper web from the press section to a drying fabric, can be used with great advantage for texturing and transferring a soft paper web from a shoe press nip directly to a Yankee dryer or some other drying cylinder. As is well known, the conditions at a Yankee dryer are completely different from those in a conventional press nip. With a Yankee dryer, no pressing of the soft paper occurs for direct dewatering. Rather it is a question of supporting the soft paper web to the envelope surface of the Yankee dryer, so that the fibers of the soft paper web adhere efficiently to the surface of the Yankee dryer, thereby achieving good heat transfer to the paper web. This is exactly the effect which is achieved with the transfer belt included in one embodiment of the paper machine according to the present invention, but cannot be achieved with a press felt as described in DE-195 48 747 due to the paper being exposed to rewetting after the last press nip in the press section, which prevents satisfactory adhesion. Neither can it be achieved, or only to a minor extent, with a transfer belt as described in U.S. Pat. No. 5,393,384 for the reason stated above. The compressibility of the transfer belt used in the paper machine according to the invention results in lower specific pressure at the adhesion point, which in turn offers increased rate of operation, i.e., higher production rate. This property also results in increased vaporization of water from the soft paper web, i.e., quicker drying of the soft paper web on the Yankee dryer, which also contributes to higher production rates.

The paper machine according to the invention, the press nips of which being single-felted, produces a textured fibrous web with a high dry solids content before the drying section, viz. up to 55%, which should be compared with the dry solids contents of up to 45% achieved with paper machines in practical use today. This improvement can be utilized either to run the paper machine at a higher production rate or to reduce the energy consumption in the drying section. It is also then possible to reduce the diameter of the drying cylinder.

With the embodiments shown and described, a guide roll may be arranged, if desired, in the loop of the substantially impermeable texturing belt 16 immediately before the transfer roll 17.

With the embodiments shown and described, a transfer member is used constituted by the transfer roll 17. According to an alternative embodiment (not shown), the transfer roll is replaced by the substantially impermeable texturing belt itself, which is allowed to run around a predetermined part of the drying cylinder, e.g., within a sector angle of 30° to 60°, to form an extended transfer nip with the drying cylinder.

Although the embodiments of the paper machine described above all have press sections comprising a shoe press, the invention is also applicable when the press section lacks a shoe press and instead has at least one press with two press rolls, of which the press roll around which the press felt runs is a suction roll, a grooved roll or a blind-drilled roll.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A paper machine for texturing and drying a wet fibrous paper web, said paper machine comprising:

a press having two cooperating press members forming a press nip between the press members for pressing the fibrous web and removing water from the web;

a heated drying cylinder downstream of the press for receiving the pressed fibrous web about a portion of the surface of the cylinder and thereby further drying the fibrous web by evaporating at least part of the water remaining in the web; and a substantially impermeable texturing belt having a web-contacting surface defining a multitude of regularly distributed depressions and surface portions located between the depressions, said substantially impermeable texturing belt being arranged to pass with the fibrous web through the press such that the depressions of the web-contacting surface initially form in the fibrous web an equivalent textured pattern having thicker and thinner portions, and said substantially impermeable texturing belt being further arranged to then carry the fibrous web to the heated drying cylinder such that the surface portions of the belt engage the thinner portions of the web against the surface of the cylinder and the water in the thicker portions of the web is caused to evaporate.

2. A paper machine as claimed in claim 1 wherein said substantially impermeable texturing belt further comprises a back layer and a web-contacting layer comprising a compressible polymer layer having a hardness in the range from 50 to 97 Shore A, and defining the web-contacting surface, said web-contacting surface having a pressure responsive, recoverable degree of roughness in an unloaded state of $R_z$=2 to 80 $\mu$m, measured in accordance with ISO 4287, Part I, and a lower degree of roughness of $R_z$=0 to 20 $\mu$m when the polymer layer is compressed by a linear load of 20 to 200 kN/m as measured in a nonextended press nip.

3. A paper machine as claimed in claim 1 wherein said substantially impermeable texturing belt further comprises a back layer and a web-contacting layer, said web-contacting layer being formed from a fabric coated with a polymer so as to form a structure comprising said depressions and said surface portions therebetween, said surface portions having an arched or convex shape.

4. A paper machine as claimed in claim 3 wherein said arched or convex surface portions comprise a plurality of knuckles formed by fabric threads extending in one and the same direction and which are uniformly distributed in a number of 25 to 150 knuckles/cm$^2$.

5. A paper machine as claimed in claim 1 further comprising a felt arranged to run through the press section against the wet web for receiving water pressed from the web.

6. A paper machine as claimed in claim 1 wherein the press comprises at least one shoe press and the press members comprise a shoe press roll and a counter roll to form an extended nip therebetween.

7. A paper machine as claimed in claim 6 further comprising another press arranged upstream of the shoe press and the press members comprise a suction press roll and a press roll.

8. A paper machine as claimed in claim 1 and further comprising a headbox for forming the web against the substantially impermeable textured belt.

9. A paper machine as claimed in claim 1 wherein the air permeability of the substantially impermeable texturing belt is less than 6m$^3$/m$^2$/minute, measured in accordance with the procedure described in "Standard Test Method for Air Permeability of-Textile Fabrics, ASTM D 737-75, American Society of Testing and Materials".

10. A paper machine as claimed in claim 1 further comprising a transfer roll arranged to engage the substantially impermeable texturing belt and paper web against the surface of the drying cylinder.

11. A paper machine as claimed in claim 2 wherein the depressions take up from 20% up to 50% of the web-contacting surface.

12. A paper machine as claimed in claim 2 wherein the depressions are continuous grooves in the web-contacting surface, which grooves are arranged in one or more groups, the grooves in one and the same group extending in one and the same direction.

13. A paper machine as claimed in claim 12 wherein the distance (a) between two grooves in one and the same group is within the interval 1 to 3 mm, the width (b) of the groove is within the interval 0.5 to 1.0 mm and its depth (c) is within the interval 0.1 to 1.0 mm.

14. A paper machine as claimed in claim 12 wherein the grooves extend in the machine direction or form an angle of 10° to 80° therewith.

15. A paper machine as claimed in claim 12, wherein the grooves are arranged in a first group in which the grooves extend in one and the same direction, and in a second group in which the grooves extend in one and the same direction forming an angle a with the direction of the grooves in the first group, which angle $\alpha$ is 10° to 170°.

16. A paper machine as claimed in claim 12 wherein the grooves are straight or wave shaped.

17. A paper machine as claimed in claim 2 wherein the depressions are hollows of the same or similar geometric shapes including circular, elliptical, or polygon shape, the largest dimension of each lying within the interval 0.5 to 3 mm and depth within the interval 0.5 to 1 mm.

18. A paper machine as claimed in claim 2 wherein at least some of the depressions are hollows of non-geometric symbol shapes including numbers, letters, trade or company symbols with depths within the interval 0.5 to 1 mm.

19. A paper machine for texturing and drying a wet fibrous paper web, said paper machine comprising:

a press having two cooperating press members forming a press nip between the press members for pressing the fibrous web and removing water from the web;

a heated drying cylinder downstream of the press for receiving the pressed fibrous web about a portion of the surface of the cylinder and thereby further drying the fibrous web by evaporating at least part of the water remaining in the web;

a substantially impermeable texturing belt having a web-contacting surface defining a multitude of regularly distributed depressions and surface portions located between the depressions, said substantially impermeable texturing belt being arranged to pass with the fibrous web through the press such that the depressions of the web-contacting surface initially form in the fibrous web an equivalent textured pattern having thicker and thinner portions, and said substantially impermeable texturing belt being further arranged to then carry the fibrous web to the heated drying cylinder such that the surface portions of the belt engage the thinner portions of the web against the surface of the cylinder and the water in the thicker portions of the web is caused to evaporate; and a hood at least partially covering the heated drying cylinder.

20. A paper machine as claimed in claim 19 and further comprising a headbox for forming the web against the substantially impermeable textured belt.

21. A paper machine as claimed in claim 19 wherein the air permeability of the substantially impermeable texturing belt is less than $6m^3/m^2$/minute, measured in accordance with the procedure described in "Standard Test Method for Air Permeability of Textile Fabrics, ASTM D 737-75, American Society of Testing and Materials".

22. A paper machine as claimed in claim 19 further comprising a transfer roll arranged to engage the substantially impermeable texturing belt and paper web against the surface of the drying cylinder.

23. A method of texturing and drying a wet fibrous paper web comprising the steps of:

advancing the wet fibrous web through a press and pressing the fibrous web to remove water from the web;

advancing the fibrous web to a heated drying cylinder;

extending the fibrous web about a portion of the heated drying cylinder to further dry the fibrous web by evaporating at least part of the water remaining in the web;

carrying the fibrous web between the press and the drying cylinder with a substantially impermeable and compressible texturing belt which extends through the press and to the surface of the drying cylinder for engaging the fibrous web against the drying cylinder;

compressing the substantially impermeable and compressible texturing belt from an uncompressed state against the fibrous web and heated drying cylinder;

texturing the fibrous web with a web-contacting surface of me substantially impermeable and compressible belt which defines a multitude of regularly distributed depressions, said texturing step occurring while the belt and fibrous web are advancing through the press and as the fibrous web is engaged against the drying cylinder so that the depressions form a textured pattern on the fibrous web; and allowing the substantially impermeable and compressible texturing belt to return to the uncompressed state after said compressing step to enhance evaporation of water from the web when on the heated drying cylinder.

24. A method as claimed in claim 23 further comprising the step of applying a continuous layer of adhesive on the surface of the drying cylinder and/or the textured fibrous web for promoting adhesion of the fibrous web to the drying cylinder.

25. A method as claimed in claim 23 wherein the substantially impermeable and compressible texturing belt also carries the fibrous web from the headbox for forming the web to the press.

26. A method as claimed in claim 23 wherein the fibrous web is engaged against the drying cylinder with the assistance of a transfer roll.

27. A method as claimed in claim 23 wherein the fibrous web is engaged against the drying cylinder by wrapping the web around at least a portion of the drying cylinder.

28. A method of texturing and drying a wet fibrous paper web comprising the steps of:

advancing the wet fibrous web through a press and pressing the fibrous web to remove water from the web;

advancing the fibrous web to a heated drying cylinder;

extending the fibrous web about a portion of the heated drying cylinder to further dry the fibrous web by evaporating at least part of the water remaining in the web;

carrying the fibrous web between the press and the drying cylinder with a substantially impermeable texturing belt which extends through the press and to the surface of the drying cylinder for engaging the fibrous web against the drying cylinder, and texturing the fibrous web with a web-contacting surface of the substantially impermeable belt which defines a multitude of regularly distributed depressions, said texturing step occurring while the belt and fibrous web are advancing through the press and as the fibrous web is engaged against the drying cylinder so that the depressions form a textured pattern on the fibrous web.

29. A method as claimed in claim 28 further comprising the steps of:

advancing a press felt through the press with the fibrous web to receive water pressed therefrom; and advancing the press felt immediately after the press in a direction away from the impermeable texturing belt before a water film formed in the press nip on the substantially impermeable texturing belt breaks up.

30. A method as claimed in claim 28 further comprising the step of applying a continuous layer of adhesive on the surface of the drying cylinder and/or the textured fibrous web for promoting adhesion of the fibrous web to the drying cylinder.

31. A method as claimed in claim 28 wherein said pressing step is performed by a shoe press with an extended nip.

32. A method as claimed in claim 31 further comprising the step of pressing the fibrous web in a roll press arranged upstream of the shoe press and including a suction press roll and a counter roll.

33. A method as claimed in claim 28 wherein the substantially impermeable texturing belt also carries the fibrous web from the headbox for forming the web to the press.

34. A method as claimed in claim 28 wherein the fibrous web is engaged against the drying cylinder with the assistance of a transfer roll.

35. A method as claimed in claim 28 wherein the fibrous web is engaged against the drying cylinder by wrapping the web around at least a portion of the drying cylinder.

36. A method as claimed in claim 29 further comprising the step of carrying the fibrous web to the press on the press felt.

* * * * *

UNITED STATES PATENT AND TRADEMARK OFFICE

CERTIFICATE OF CORRECTION

PATENT NO. : 6,547,924 B2
DATED : April 14, 2003
INVENTOR(S) : Klerelid et al.

It is certified that error appears in the above-identified patent and that said Letters Patent is hereby corrected as shown below:

Column 12,
Line 2, after "of" cancel the dash "-";
Line 28, "a" should read -- *a* --.

Column 13,
Line 33, "me" should read -- the --.

Signed and Sealed this

Eleventh Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,547,924 B2
DATED : April 14, 2003
INVENTOR(S) : Klerelid et al.

It is certified that error appears in the above-identified patent and that said Letters Patent is hereby corrected as shown below:

Column 12,
Line 2, after "of" cancel the dash "-";
Line 28, "a" should read -- $\hat{a}$ --.

Column 13,
Line 33, "me" should read -- the --.

This certificate supersedes Certificate of Correction issued November 11, 2004.

Signed and Sealed this

Twenty-eighth Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,547,924 B2
DATED : April 15, 2003
INVENTOR(S) : Klerelid et al.

It is certified that error appears in the above-identified patent and that said Letters Patent is hereby corrected as shown below:

Column 12,
Line 2, after "of" cancel the dash "-";
Line 28, "a" should read -- α --.

Column 13,
Line 33, "me" should read -- the --.

This certificate supersedes Certificate of Correction issued November 11, 2004 and September 28, 2004.

Signed and Sealed this

Twenty-ninth Day of March, 2005

JON W. DUDAS
*Director of the United States Patent and Trademark Office*